US006774813B2

(12) United States Patent
van Ee et al.

(10) Patent No.: US 6,774,813 B2
(45) Date of Patent: Aug. 10, 2004

(54) SYSTEM AND METHOD FOR INTERLEAVING INFRARED COMMAND CODES WITH IDENTIFIER CODES

(75) Inventors: Jan van Ee, Cupertino, CA (US); Frederik Ekkel, Cupertino, CA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 462 days.

(21) Appl. No.: 09/823,375

(22) Filed: Mar. 30, 2001

(65) Prior Publication Data

US 2002/0140569 A1 Oct. 3, 2002

(51) Int. Cl.[7] ..... G08G 19/00
(52) U.S. Cl. ..... 340/825.69; 340/825.72; 345/717
(58) Field of Search ..... 340/825.69, 825.72; 345/717; 348/734; 235/462

(56) References Cited

U.S. PATENT DOCUMENTS 4,992,649 A * 2/1991 Mampe et al. ..... 209/546
5,629,868 A * 5/1997 Tessier et al. ..... 364/514
5,726,645 A * 3/1998 Kamon et al. ..... 340/825.22
6,597,374 B1 * 7/2003 Baker et al. ..... 345/717

* cited by examiner

*Primary Examiner*—Brian Zimmerman
*Assistant Examiner*—Matsuichiro Shimizu
(74) *Attorney, Agent, or Firm*—Dicran Halajian

(57) ABSTRACT

A universal programmable remote is programmed for being used with a specific apparatus. A sequence of test codes is sent to the apparatus until the apparatus responds. The test codes comprise tags that are sent along. The tags fall all within a same narrow frequency band. An STB that is eavesdropping on the transmission is receptive to that band. The STB identifies the last tag and enables a server to identify the complete set of codes for the apparatus based on the tag. Thereupon the set is downloaded and programmed in the remote.

13 Claims, 3 Drawing Sheets

SYSTEM AND METHOD FOR INTERLEAVING INFRARED COMMAND CODES WITH IDENTIFIER CODES

BACKGROUND OF THE INVENTION

1. Technical Field

The present invention relates in general to a system and method for programming a programmable remote control device for controlling a consumer electronics (CE) apparatus.

2. Background of the Related Art

A remote controller communicates control signals according to the particular user-input activated on the device, e.g., a button or a soft-key. The majority of modern wireless remote control devices use an infrared (IR) pulse command code modulated carrier to send the control signals. The command code is binary and varies in time duration and in bit length. The command code is modulated with a frequency. Different brands of equipment and different types of equipment of the same brand operate under control signals that are modulated with different frequencies or are encoded differently. In practice, this means that the user has to juggle a variety of different remotes when interacting with his/her audio and video equipment.

The need for a programmable universal remote control device has been recognized. Several companies manufacture and market programmable remote control devices. Generally, these devices have a learning mode feature where they can learn command codes associated with equipment of different manufacturers.

U.S. Pat. No. 5,819,294, herein incorporated by reference, and issued to Paul Chambers, relates to programming a universal programmable remote controller. The remote is programmed via a PC that has an onboard database for sets of codes used by a variety of commercially available remote controllers. The database contains sets of compressed codes. In order to program the remote, the user lets the PC find a match between a single pulse-code transmitted by a specific known controller on the one hand and an item in the data base on the other hand. Upon finding the match, the set containing the matching item is stored in the programmable controller as corresponding to the particular apparatus that is to be made controllable via the specific remote.

In order to determine an appropriate set of command codes for a particular apparatus to program the remote control device, the command code corresponding to a particular function, e.g., power on/off, is selected from all command code sets. A possibility to get these command codes programmed within the remote control device is, e.g., via wireless or direct connection means. Another possibility to get these command codes within the remote control device is to program it with the codes at the time of production of the device.

SUMMARY OF THE INVENTION

The invention addresses the following. An apparatus, e.g., a set top box (STB) or a PC, has access to a database of control codes (e.g., IR or RF) for programming a programmable remote control. The database resides on a server or on the apparatus itself, e.g., after a download or through a CD-ROM. The user selects the type and brand of a specific device to become controllable through the remote. The database is then queried for the code set for this device type/brand combination. Typically, the database contains multiple code sets for a given device type/brand combination. A single code set has to be selected from the sets by testing the different code sets. In order to test which set is correct for a specific device, say a VCR, the STB downloads in this test phase a specific code, e.g., the power on/off code, from every code set, to the programmable remote. The user then takes the remote control and presses a specific button on the remote control until the VCR responds to a proper one of the downloaded power on/off codes. The proper set is then the set containing the power on/off code to which the VCR responded. The set thus identified can be combined with further code sets for other equipment to be programmed in the remote control at the end of the programming process. The inventors suggest to let the STB 'eavesdrop' on the remote control communication during the testing phase. The last test code transmitted by the remote is identified as the code to which the VCR responds and thus as a representative of the proper code set. This scenario can be extended using the test protocol disclosed in U.S. Pat. No. 5,819,294 mentioned above, which takes into account different code sets having one or more codes in common. That is, each test runs until the apparatus, here the VCR responds, whereupon the relevant code is to be identified, before continuing to test the remaining power on/off test codes for identifying possibly other candidate sets.

However, the IR or RF code receiver in the STB is typically a narrow-band receiver (i.e., it is receptive to signals in a specific frequency band). Accordingly, it cannot properly work with all possible control codes for all equipment from all manufacturers when eavesdropping due to different frequency ranges being used, e.g., by different manufacturers. The frequency bands used by different manufacturers of remote control devices for, e.g., IR codes, differ widely (KHz–MHz range). The inventors therefore further suggest to interleave the device-specific control codes (e.g., the VCR power codes in the example above) with identifiers codes (referred to herein as "id codes" or "tags") to which the STB's IR or RF receiver is receptive. That is, each test control code is tagged for being identified by the STB. The tag or id code is sent in a frequency range that allows the STB to intercept it. These id codes preferably have an enumerator embedded, so that the STB is always in sync with the remote.

The present invention provides an information processing system including an apparatus with multiple user-controllable functionalities, and a programmable remote control device. The remote control device has a user-interface with multiple user inputs for selective control of a particular one of the functionalities of the apparatus through sending a particular one of multiple control signals to the apparatus once the device is programmed. The system has programming means to program the control device. The programming means is contained within, e.g., an STB. The STB can be connected via the Internet or another data network to a remote server storing a database. The database comprises a plurality of respective sets of multiple control codes. The programming means further includes means to enable a user to select the apparatus type/brand of the apparatus and means for transmitting the user-selected apparatus type/brand via the Internet to the remote server. It is also possible that, e.g., the STB itself stores the database containing a plurality of respective sets of multiple control codes, or that the database is locally available via other means, e.g., a CD-ROM.

The remote server uses the user-selected apparatus type/brand to select a single control code from all the sets of control codes corresponding to the user-selected apparatus type/brand. The selected control codes from all the sets correspond to a particular function, e.g., turning an apparatus on/off. These control codes are transmitted via the Internet to the programming means.

In an embodiment of the invention, the programming means itself includes an interleaver for interleaving the control codes with respective identifier codes. Each identifier code can be detected and decoded by an IR receiver of the programming means. The identifier codes are preferably contained within a database of identifier codes where each one is mapped with a respective control code, e.g., the control code for turning the apparatus on/off, and stored within a memory of the programming means. Alternatively, the identifier codes are stored at the remote server and are interleaved with the selected control codes at the remote server, before the entire interleaved signal is transmitted to the programming means. The interleaved control code signal is transmitted to the remote control device and the remote control device is programmed with the interleaved control code signal.

The user then tests the programmed remote control device to determine which command code within the interleaved control code signal activates the particular function of the at least one apparatus. For example, the user intermittently presses the on/off button on the remote control device to transmit a single interleaved command code, i.e., a single command code and its respective identifier code, per each press to the at least one apparatus. Once the apparatus turns on/off, the user stops pressing the on/off button.

During the user-run trials for, e.g., IR codes, the IR receiver of the programming means eavesdrops or picks up each transmitted interleaved identifier code. Accordingly, it is possible to determine the appropriate set of command codes for the at least one apparatus using the last identifier code picked up by the IR receiver. That is, the programming means associates the last identifier code picked up by the IR receiver with its associated control code using the database stored within the programming means. The associated control code is then transmitted to the remote server via the Internet where it is correlated with its corresponding set of control codes. This set of control codes is transmitted to the programming means. The programming means receives this set of control codes and programs the programmable remote control device to associate the control codes of the identified set, i.e., the set containing the command code which caused the apparatus to respond, with the multiple user inputs of the remote control device.

Alternatively, the last identifier code picked up by the IR receiver is transmitted to the remote server. The remote server then associates the last identifier code with the associated control code, and proceeds to correlate the associated control signal with its corresponding set of control codes.

Accordingly, if a particular control code cannot be detected or decoded by the STB's IR receiver, the tagging according to the present invention enables to determine the set of command codes for the apparatus to be controlled. The IR receiver picks up the identifier code corresponding to each transmitted control code interleaved with the control code in the test signal. As noted above, the identifier codes are such that they can be detected and decoded by the IR receiver of the programming means.

In an embodiment of the invention, the system is capable of accessing, via the Internet, a remote server that stores a database of sets of control codes for each major brand. The system identifies the set that matches the user's apparatus or collection of equipment. This is achieved by identifying the matching set in a few steps through the tags, and by programming the control device with the proper control code set, as identified through the tags as described above, for operational use.

Herein incorporated by reference are the following patent documents:

U.S. application Ser. No. 09/519,546 filed Mar. 6, 2000 for Erik Ekkel et al., for PERSONALIZING CE EQUIPMENT CONFIGURATION AT SERVER VIA WEB-ENABLED DEVICE. This document relates to facilitating the configuring of CE equipment by the consumer by means of delegating the configuring to an application server on the Internet. The consumer enters his/her preferences in a specific interactive Web page through a suitable user-interface of an Internet-enabled device, such as a PC, set top box, or digital cellular telephone. The application server generates the control data based on the preferences entered and downloads the control data to the CE equipment or to the Internet-enabled device.

U.S. application Ser. No. 09/653,784 filed Sep. 1, 2000 for Frank Caris et al., for STB CONNECTS REMOTE TO WEB SITE FOR CUSTOMIZED CODE DOWNLOADS. This document relates to a set top box (STB) that is marketed together with a programmable remote. The remote has a dedicated button to connect the STB to a specific server on the Internet. The consumer can notify the server of his/her other CE equipment, which he/she desires to be controllable through the same remote as the one that came with the STB. The server downloads to the STB data representative of the relevant control codes. The STB is provided with means to program the remote with these codes. In return the server has obtained detailed and accurate information about this consumer's equipment. A reliable customer base can thus be built for streamlining Help Desk operations.

U.S. Ser No. 09/271,200 filed Mar. 17, 1999 for Jan van Ee for FULLY FUNCTIONAL REMOTE CONTROL EDITOR AND EMULATOR. This document relates to a universal programmable remote control device. The device has programmability functions that enable the end-user to customize the device through editing or programming the device's control functionalities. The programming can be done via a PC. The control configuration created via an editor on the PC can be downloaded into the device. The PC has emulator software to test the configuration before downloading. The emulator software and the remote's control software are made identical as a consequence of a software layer that abstracts from the remote's hardware. The emulator for the end-user is thus obtained as an almost free byproduct of the software development phase at the manufacturer.

U.S. Ser. No. 09/311,128 filed May 13, 1999 for Joost Kemink for INTERNET-BASED SERVICE FOR UPDATING A PROGRAMMABLE CONTROL DEVICE. This document relates to an Internet based service for updating a programmable control device. An Internet site contains links to appliance-dependent control and feature option information, which can be downloaded to the programmable control as a graphic user interface (GUI). A user interface is provided at the site for the user to easily specify a target appliance, and thereafter selectively download the interface and control information that is available for the target appliance. The Internet site also contains links to other providers of configurations and macros, such as system integrators who provide interfaces based on an inventory of the user's controllable equipment, hobbyist who share configurations and macros that they've found useful, and so on.

U.S. Ser No. 09/686,572 filed Oct. 10, 2000 for Tom Dubil et al., for CONTROL CODES FOR PROGRAMMABLE REMOTE SUPPLIED IN XML FORMAT. This document relates to an Internet service that makes control codes available for use on a programmable universal remote. The remote controls CE equipment through IR or RF commands. A server supplies the control codes as XML data that gets processed at the receiver's set top box or PC, or the remote itself, for being properly installed on the remote.

BRIEF DESCRIPTION OF THE DRAWINGS

The invention is further explained by way of example and with reference to the accompanying drawings, wherein.

DETAILED DESCRIPTION OF PREFERRED EMBODIMENTS

Figure 1:
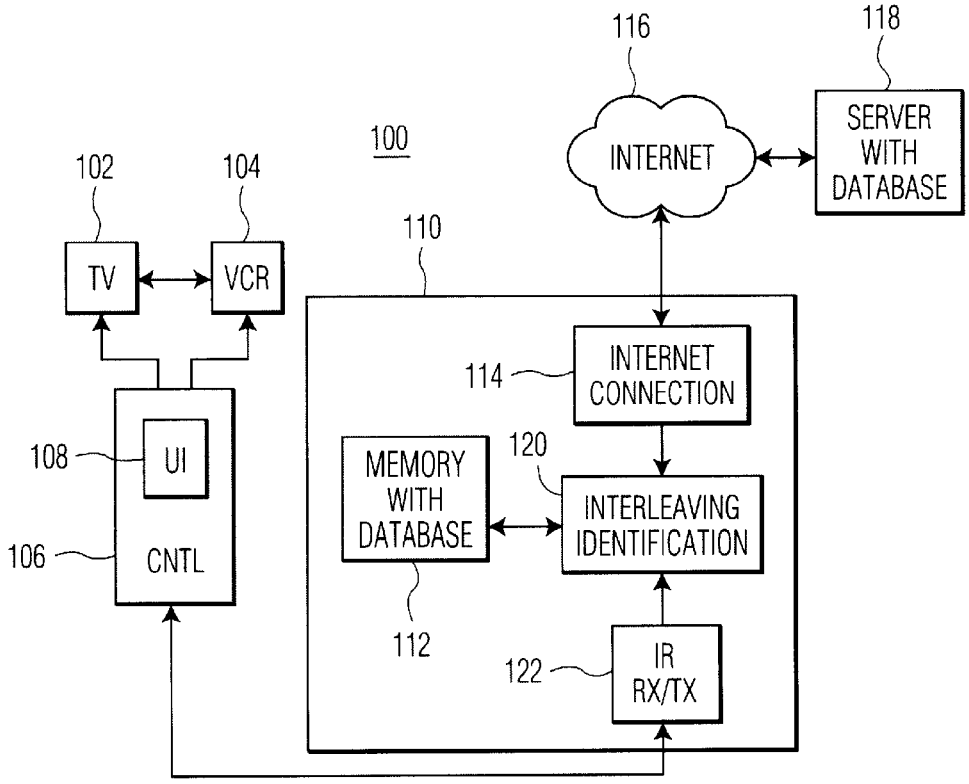
FIG. 1 is a block diagram of a system of the invention.

FIG. 1 is a block diagram of an information processing system 100 according to the invention. System 100, in this example, controls a home entertainment system. System 100 includes a first apparatus 102, here a TV. Apparatus 102 has multiple functionalities that are user-controllable, e.g., "TV-on/off", "channel up/down", "mute", "brightness up", etc. System 100 also has a second apparatus 104, here a VCR, also with multiple user-controllable functionalities: "on", "play", "record", "eject tape", etc. System 100 further includes a programmable control device 106 having a user-interface 108 with multiple user-inputs (e.g., buttons, or soft keys on a GUI, not shown). The multiple user-inputs provide selective control of a particular one of the functionalities of apparatus 102 and 104 by sending a particular one of multiple control signals once device 106 is programmed. In this example, device 106 is a programmable, hand held IR remote controller for consumer equipment. The disclosure herein, however, is not limited to hand held control devices, nor to IR communication, nor to remotes, nor to a consumer environment.

System 100 further includes programming means 110 for programming of control device 106. Programming means 110 is preferably contained within a set top box connected to TV set 102 and includes a memory 112 having a database containing apparatus type/brand combinations. The database further contains identifier codes mapped to an associated control code.

Programming means 110 further includes Internet connection hardware 114, such as a modem, for connecting via the Internet 116 with a remote server 118 having a database containing a plurality of respective sets of multiple control signals in, e.g., a compressed digital format. Each respective set includes control signals for control of a respective one of a plurality of apparatus. The apparatus may differ in type, e.g., a TV receiver versus a DVD-player; and/or the apparatus may differ in brand, e.g., Philips Electronics™, etc.

To select an apparatus type/brand combination corresponding to the apparatus to be controlled, e.g., TV set 102 or VCR 104, the database of the memory 112 is, e.g., accessible by pushing access buttons (not shown) on the set top box or remote control 106. Preferably a database contents representation is displayed on TV set 102. The user then, using the access buttons, e.g., up/down buttons and an "ENTER" button, selects the apparatus type/brand combination. The selected apparatus type/brand combination is then transmitted via the Internet 116 to remote server 118.

Remote server 118 receives the user-selected apparatus type/brand combination and searches its database to identify sets of respective control codes corresponding to the apparatus type/brand combination. Upon identifying such sets, remote server 118 selects a control code from each set corresponding to a particular control function and transmits the selected control codes via the Internet 116 to programming means 110. The selected control codes are, for example, the IR control codes that control a particular functionality X (on/off) of an apparatus of a particular type Y (TV set 102) manufactured by a particular company Z (Philips Electronics™). The selected control codes correspond to the control codes that are mapped to identifier codes and are stored in the database within programming means 110.

Upon being received by programming means 110, the control codes are transmitted to an interleaver/identifier circuit 120 of the programming means 110. The circuit 120 associates each control code with its respective identifier code stored in the database and interleaves each control code with its respective identifier code to form an interleaved control signal, i.e., a signal having a string of control codes and respective identifier codes.

Circuit 120 transmits the interleaved control signal to the programmable control device 106 via an IR transmitter of an IR receiver/transmitter circuit (IR RX/TX) 122 of programming means 110. The control device 106 receives the interleaved control signal and is programmed accordingly, i.e., to transmit the interleaved control signal if a button is pressed on user-interface 108 corresponding to the function of the selected control codes.

To test which of the selected control codes causes the apparatus to be controlled to respond appropriately, the button on user-interface 108 which corresponds to the function of the selected control codes is intermittently pressed. As the button is intermittently pressed, each identifier code and its associated control code in the interleaved control signal are transmitted. An IR receiver of the IR receiver/transmitter circuit 122 of programming means 110 eavesdrops or picks up each identifier code transmitted by the control device 106. The user stops intermittently pressing the button on user-interface 108 once the apparatus to be controlled responds, e.g., TV set 102 turns on.

Once the user stops intermittently pressing the button on user-interface 108, interleaver/identifier circuit 120 samples the last identifier code picked up by IR receiver 122, i.e., the identifier code associated with the control code which caused the apparatus to respond, and converts the sampled signal into a digital word of, e.g., a compressed data format. The compressed data format is then matched with a compressed data format of an identifier code stored within memory 112 to identify the identifier code that caused the apparatus to respond.

Programming means 110 then correlates the matched compressed data format of the last identifier code received with its associated control code stored in the database. The associated control code is then transmitted to remote server 118 via Internet 116. Remote server 118 uses the associated control code to determine to which set of control codes it belongs to and transmits the set to programming means 110.

Programming means 110 receives the set of control codes and programs programmable control device 106 to associate the control codes of the identified set, i.e., the set containing the control code which caused the at least one apparatus to respond, with the multiple user inputs of programmable control device 106. Configuration of control device 106 for another apparatus can then be performed in a similar manner.

With the present invention, if the transmitted control code cannot be read by IR receiver 122 of programming means 110, the appropriate set of control codes can still be determined by using the last identifier code picked up by IR receiver 122. This is explained in farther detail below with reference to FIG. 2.

Programming means 110 is integrated with, for example, a computer that is accommodated with suitable interfaces to receive the signals from programmable control device 106. Typically, such a computer forms the center part of a home entertainment system and serves both to control the consumer equipment, e.g., for playing video games and to provide access to the Internet with a web browser.

Preferably, UI 108 includes a GUI on a display (not shown) with touch screen functionality. UI 108 provides a layout with graphical representations of selectable and controllable functionalities for equipment in a home entertainment system. Preferably, the data that is representative of the identified set of control codes also includes the graphics information for the visual representation of the selectable and controllable items on TV set 102 for the set corresponding with this particular control mode. That is, each set not only includes data representative of the control codes or IR commands, but also for the graphics information.

Figure 2A:
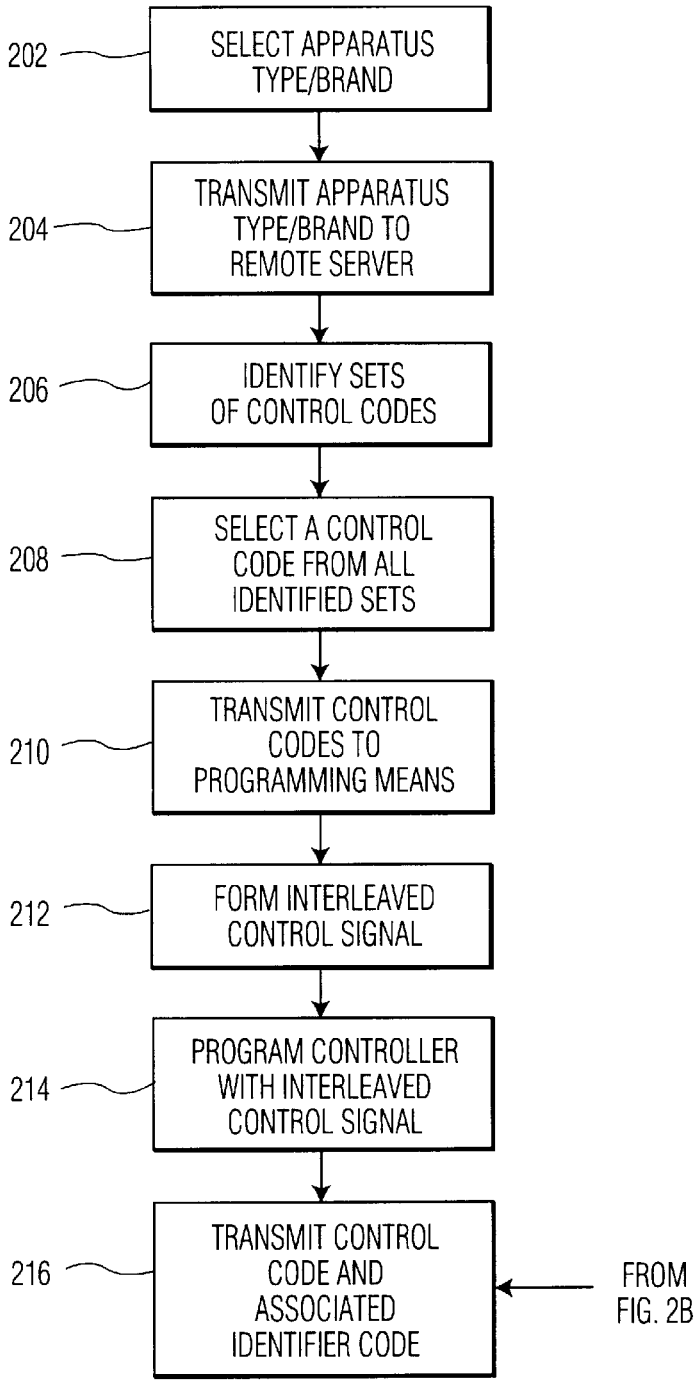
FIGS. 2A and 2B are flow diagrams explaining the steps in the programming of the control device according to the present invention.
Figure 2B:
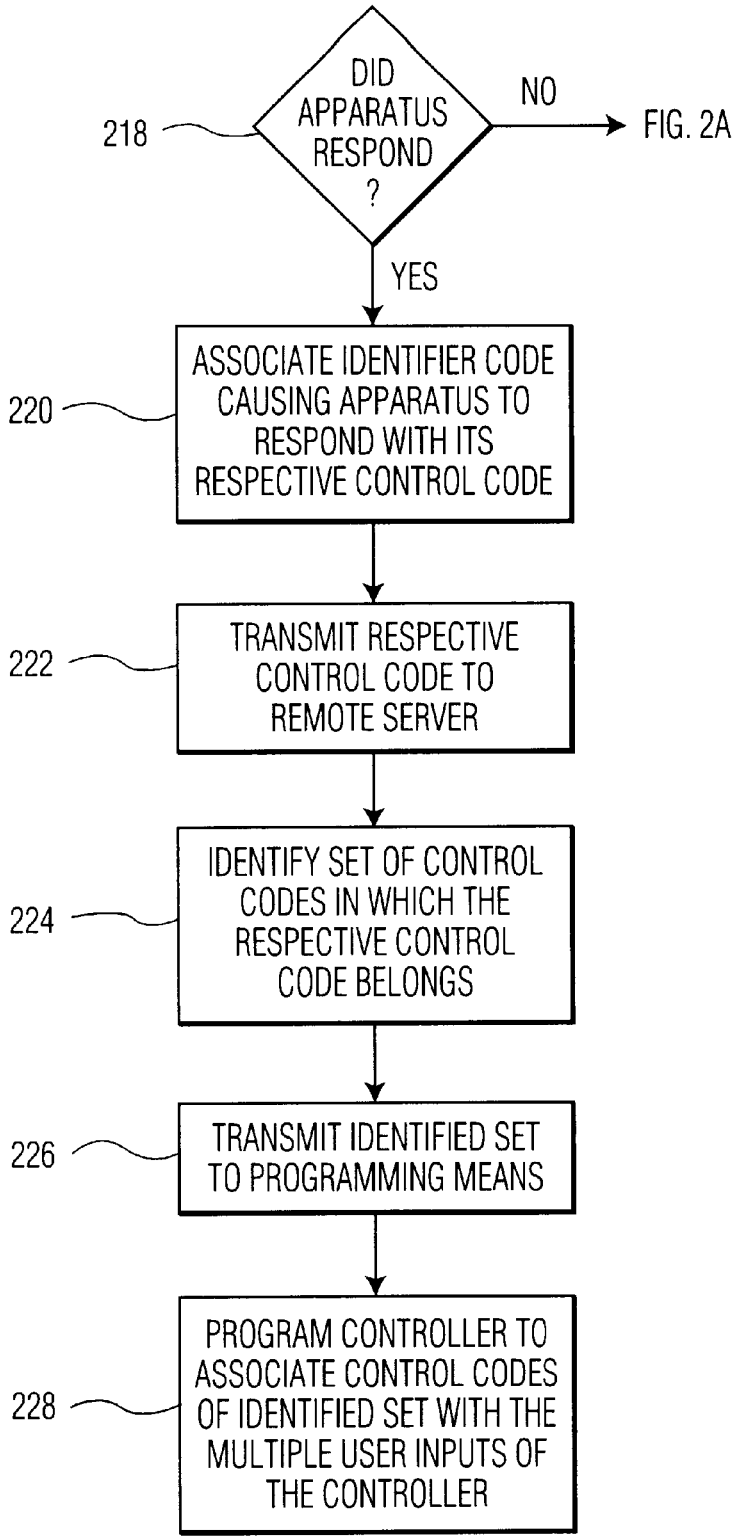

FIGS. 2A and 2B are flow diagrams illustrating the procedure for programming programmable control device 106 according to the present invention. In step 202, a user selects an apparatus type/brand combination from combinations stored in the database of memory 112 of programming means 110. The user-selected apparatus type/brand combination is transmitted to remote server 118 in step 204. Remote server 118 identifies all the sets of control codes corresponding to the user-selected apparatus type/brand combination in step 206. A particular control code corresponding to a particular function of the apparatus to be controlled is then selected from all the identified sets in step 208. The control codes are then transmitted via Internet 116 to programming means 110 in step 210.

The control codes are interleaved with associated identifier codes stored in memory 112 to form the interleaved control signal in step 212. The interleaved control signal is transmitted to control device 106 in step 214 to program the control device 106. The button on user-interface 108 is then pressed on control device 106 to transmit a control code and its associated identifier code for each press in step 216. In step 218, the user determines whether the apparatus to be controlled responded to the transmitted control code. If no, the process returns to step 216.

If it is determined that the apparatus responded to the transmitted control code in step 218, the identifier code associated with the control code which caused the apparatus to respond is then associated with its respective control code in step 220 using the database stored within memory 112. The respective control code is then transmitted to remote server 118 via Internet 116 in step 222. Remote server 118 identifies the set of control codes in which the respective control code belongs to in step 224. The identified set is then transmitted to programming means 110 in step 226. Programming means 110 receives the identified set in step 228 and programs control device 106 to associate the control codes of the identified set, i.e., the set containing the control code which caused the at least one apparatus to respond, with the multiple user inputs of programmable control device 106.

In case in step 218 it is determined that the apparatus did not respond to any of the control codes of the interleaved control signal transmitted thereto, the programming means 110 or programmable control device 106 is designed to allow the user to push a button on the programmable control device 106, or on the UI 108, to interrupt the process of FIGS. 2A and 2B.

Control device 106 is preferably re-programmable, e.g., in case the user replaces a piece of equipment by another one that requires another set of control signals.

It will be understood that various modifications may be made to the embodiments disclosed herein and that the above description should not be construed as limiting, but merely as exemplifications of preferred embodiments. For example, the identifier codes may be stored at remote server 118 and remote server 118 interleaves the selected control codes with the identifier codes to form the interleaved control signal. Further, the information processing system 100 of the present disclosure may be designed to operate by using other type of signals, instead of IR signals, such as RF signals. Accordingly, those skilled in the art will envision other modifications within the scope and spirit of the claims appended hereto.

What is claimed is:

1. A method for enabling a user to program a remote control device for remote control of an apparatus, the method comprising:

enabling to send respective interleaved control signals, representative of the respective test control codes, sequentially to the apparatus until the apparatus responds to a specific test control code, the interleaved control signal comprising a control code and an associated, corresponding identifier code wherein:

each respective test control code is representative of a respective set of multiple control codes for controlling the apparatus;

enabling to monitor the sending of the respective interleaved control signals;

enabling to identify a specific set of the multiple control codes corresponding to the identifier code for the interleaved control signal; and enabling to render the specific set operational on the remote control device.

2. The method of claim 1, wherein the remote control device is pre-programmed with the respective test control codes.

3. The method of claim 1, wherein the respective sets are preprogrammed on the remote control device.

4. The method of claim 1, wherein the respective test codes are supplied from a remote server via a data network.

5. The method of claim 1, wherein the specific set is supplied from a remote server via a data network.

6. The method of claim 1, wherein the enabling to monitor comprises enabling a set-top box to monitor the sending of the identifier codes.

7. A first database comprising a plurality of respective sets of control codes, at least one set for use with a system comprising a programmable remote control device, a programming means, and an apparatus responsive to at least one set of control codes in the database, the first database including control codes representing frequencies that cannot be picked-up by the programming means and the first or a second database comprising identifier codes representing frequencies that can be picked-up by the programming means to enable the generation of an interleaved control signal for the identification of a set of control codes in the database for controlling the apparatus through the remote control device.

8. A plurality of respective test codes for being sent in a sequence of respective interleaved control signals for probing a response of a remote controllable apparatus, the respective interleaved control signals comprising control codes and associated, corresponding identifier codes, wherein at least a portion of the interleaved control signals representing identifier codes are being sent in a predetermined frequency that can be picked-up by a programming means for a programmable remote control device.

9. A programmable remote control device configured for sequentially sending respective interleaved control signals comprising test control codes and associated, corresponding identifier codes to an apparatus until the apparatus responds to a specific one of the interleaved control signals, wherein the device is configured to receive a set of control codes for controlling the apparatus based on a programming means for the device responding to an identifier code in the interleaved control signal following a response by the apparatus to a test control code in the interleaved control signal.

10. Data processing equipment comprising a receiver for wireless input in a specific frequency band, and having software to identify a last one in a sequence of multiple tags received as wireless input, for upon identifying the last one sending a message via a data network to a remote server; the data processing equipment further comprising an interleaver circuit for associating an identifier code with a respective control code to form an interleaved control signal having a predetermined frequency, the data processing equipment being able to pick-up the frequency of at least a portion of the interleaved control signal representing the identifier code.

11. The equipment of claim 10 comprising a set top box.

12. Software for being installed on data processing equipment, the equipment comprising a receiver for wireless input in a specific frequency band, the software being operational to identify a last one in a sequence of multiple interleaved control signals received as wireless input, and for upon identifying the last one, sending a message via a data network to a remote server; the data processing equipment including an interleaver circuit for associating an identifier code with a corresponding control code to form an interleaved control signal having a predetermined frequency, the data processing equipment being able to pick-up the frequency of at least a portion of the interleaved control signal representing the identifier code.

13. The software of claim 12, for receiving via the data network a set of control codes in response to the sending of the message, the control codes being suitable for being programmed into a programmable remote control device.

* * * * *